US006239086B1

(12) United States Patent
Hirano et al.

(10) Patent No.: US 6,239,086 B1
(45) Date of Patent: May 29, 2001

(54) REFRIGERATING MACHINE OIL

(75) Inventors: Hiroyuki Hirano; Satoshi Suda; Yuji Shimomura, all of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/399,854

(22) Filed: Sep. 21, 1999

(30) Foreign Application Priority Data

Sep. 21, 1998 (JP) ..... 10-266444

(51) Int. Cl.[7] ..... C10M 107/34
(52) U.S. Cl. ..... 508/579; 252/68
(58) Field of Search ..... 252/68; 508/579

(56) References Cited

U.S. PATENT DOCUMENTS 4,248,726 * 2/1981 Luchinuma et al. ..... 252/68
4,851,444 * 7/1989 Mc Graw ..... 252/68
4,948,525 * 8/1990 Sasaki et al. ..... 508/579
5,413,728 * 5/1995 Mall et al. ..... 508/579
5,595,678 * 1/1997 Short et al. ..... 508/579
5,688,433 * 11/1997 Kassahara et al. ..... 508/579

* cited by examiner

*Primary Examiner*—Jacqueline V. Howard
(74) *Attorney, Agent, or Firm*—Akin, Gump, Strauss, Hauer & Feld, L.L.P.

(57) ABSTRACT

Refrigerating machine oils comprises for use with a refrigerant containing ammonia, which comprises a polypropylene glycol monoether represented by the formula

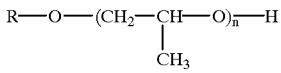

(1)

wherein R is an alkyl group having 1 to 10 carbon atoms and n is an integer to be selected such that the number-average molecular weight becomes 500 to 5,000.

9 Claims, No Drawings

REFRIGERATING MACHINE OIL

BACKGROUND OF THE INVENTION

1. Field of the Invention

This invention relates to refrigerating machine oils, more particularly to such a refrigerating machine oil suitable for a refrigerating machine using ammonia as a refrigerant.

2. Description of the Prior Art

Due to the recent issues concerning with the ozone shield depletion, conventional refrigerants for refrigerating machine such as CFC (chlorofluorocarbon) and HCFC (hydrochlorofluorocarbon) have been targeted for regulation. In place of these refrigerants, HFC (hydrofluorocarbon) has been used as such a refrigerant. However, since the HFC refrigerant also has a problem that it is high in Global Warming Potential (GWP), it has been considered to use refrigerants containing natural materials as alternative refrigerants for the fluorocarbon type refrigerants.

Conventionally, ammonia has been used as a refrigerant for the industrial use, and mineral oils have been used as refrigerating machine oils for use with an ammonia refrigerant. However, due to inmiscibility of ammonia with mineral oils, it is rather difficult for the oil pumped out from a compressor to return to the compressor through the refrigerating cycle, resulting in poor lubricity in the compressor and the reduction of efficiency of heat exchange. Under these circumstances, the development and research of a refrigerating machine oil miscible with ammonia has been progressed.

When ammonia is used as a refrigerant, water possibly enters into a refrigerating cycle due to the hygroscopicity of ammonia itself which is extremely high, compared with fluorocarbon type refrigerants. When a refrigerating machine oil containing a mineral oil is used, the water entering into a refrigerating cycle creates a problem that the water separated from the oil freezes and closes the line of the refrigerating cycle, which adversely affect the stability of the refrigerant and oil and of the pipings of the system. Therefore, a refrigerating machine oil for use with an ammonia refrigerant is required to be stable in the presence of water.

A study has been placed on a PAG (polyalkylene glycol) compound as disclosed in Japanese Patent Laid-Open Publication No. 5-009483 to use as a refrigerant which is miscible with ammonia. An oxyethylene oxypropylene copolymer has been regarded as being superior in miscibility and fluidity at low temperatures.

However, the use of PAG containing an oxyethylene group in its molecule poses a problem in terms of stability when water and oxygen enter into a refrigerating cycle. For the foregoing reasons, it has not been accomplished to develop a refrigerating machine oil for use with an ammonia refrigerant which has satisfyingly required properties such as lubricity, miscibility with a refrigerant, fluidity at low temperatures and stability, in a well-balanced manner.

In view of the foregoing, it is an object of the present invention to provide a refrigerating machine oil which can meet all of the requirements such as lubricity, miscibility with a refrigerant, fluidity at low temperatures and stability, in a well-balanced manner when used with an ammonia refrigerant.

SUMMARY OF THE INVENTION

An extensive research and investigation found that it is made possible to obtain a refrigerating machine oil which is improved in stability and has capabilities such as lubricity and miscibility with a refrigerant in a well balanced manner by using specific types of PAG monoethers which have been recognized as being defective in terms of stability, as a base oil.

According to the present invention, there is provided a refrigerating machine oil for use with an ammonia refrigerant which comprises a polypropylene glycol monoether represented by the formula

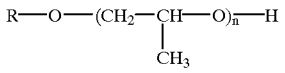

(1)

wherein R is an alkyl group having 1 to 10 carbon atoms and n is an integer to be selected such that the number-average molecular weight of the oil becomes 500 to 5,000.

DETAILED DESCRIPTION OF THE INVENTION

The refrigerating machine oil according to the present invention comprises a polypropylene glycol monoether represented by the formula

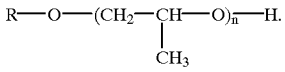

(1)

In formula (1), R is an alkyl group having 1 to 10 carbon atoms which may be of straight- or branched-chain type. Specific examples of such alkyl groups are methyl, ethyl, straight or branched propyl, straight or branched butyl, straight or branched pentyl, straight or branched hexyl, straight or branched octyl, straight or branched nonyl and straight or branched decyl groups. Among these groups, preferred are methyl, ethyl, straight or branched propyl and straight or branched butyl groups in view of miscibility and fluidity at low temperatures. In view of lubricity, more preferred are straight or branched alkyl group having 6 to 10 carbon atoms and further more preferred are those having 8 to 10 carbon atoms. Alkyl groups having more than 10 carbon atoms are not preferred in view of miscibility and fluidity at low temperatures.

In formula (1), n represents an integer to be selected such that the number-average molecular weight of the oil becomes 500 to 5,000. In view of improving the sealing capability of a compressor, the number-average molecular weight is preferably more than 600. Furthermore, in view of miscibility with a refrigerant, the number-average molecular weight is preferably less than 3,000, more preferably less than 1,500.

The polypropylene glycol monoether used in the present invention has a pour point of preferably less than −10° C., more preferably −20 to −50° C. in view of less possibility that the resulting refrigerating machine oil reduced in fluidity in a refrigerating cycle.

Preferred polypropylene glycol monoethers are those having a kinematic viscosity at 100° C. of less than 2 $mm^2/s$ in view of the capability of maintaining the sealing of a compressor. More preferred are those having a kinematic viscosity at 100° C. of less than 2 $mm^2/s$ in view of miscibility with ammonia.

The ratio (Mw/Mn) of weight average molecular weight (Mw) to the number-average molecular weight (Mn) is preferably within the range of 1.00 to 1.20 in view of improving miscibility with ammonia.

When a consideration given to the necessity of decreasing the amount of moisture entering into a refrigerating system to the utmost, the water content of the polypropylene glycol monoester used in the invention is less than 500 ppm, preferably less than 200 ppm, more preferably less than 100 ppm. Polyglycol-based oils are generally high in hygroscopicity and the PAG monoethers of the present invention are higher in hygroscopicity, compared with diehters. Therefore, it is necessary to pay meticulous attention to the moisture content of the oil to be introduced into a refrigerating system. However, on the other hand, due to higher hygroscopicity of ammonia than fluorocarbonaceous refrigerants such as HFC (hydrofluorocarbon), the moisture entering into a refrigerating system upon the introduction of the refrigerant thereto tends to cause e a problem. If a PAG monoethers having high hygroscopicity coexists with a refrigerant in a refrigerating system, it can prevent the moisture entering therein from liberating by capturing it into the molecules, thereby avoiding harmful influences caused by the deterioration of the refrigerant and the pipings in the system and the freezing of the moisture.

The content of the polypropylene glycol monoether in the refrigerating machine oil of the present invention is not particularly limited, but is preferably more than 50 mass percent, more preferably more than 70 mass percent, further more preferably more than 80 mass percent, most preferably more than 90 mass percent, based on the total mass of the oil, because the resulting oil can be imparted with various superior characteristics such as lubricity, miscibility with a refrigerant, thermal and chemical stability and electric insulation.

A refrigerating machine oil according to the present invention comprises the above mentioned polypropylene glycol monoether but may further comprise a hydrocarbon base oil such as mineral oils, olefin polymers, naphthalene compounds and alkylbenzene oils and oxygen-containing synthetic oils such as an ester, ketone, polyphenyl ether, silicone, polysiloxane, perfluoro ether, polyvinyl ether and polyglycol which is not incorporated within the scope of the present invention. Among these oxygen-containing synthetic oils, preferred are polyvinyl ether and polyglycol other than the above described polyglycol of the present invention.

The refrigerating machine oil of the present invention comprises the above described polypropylene glycol monoether and alternatively a hydrocarbon oil and/or an oxygen-containing synthetic oil as a base oil. Although the inventive refrigerating machine oil can be put in use without being blended with an additive, any of various additives can be added as required.

An amine-based oxidation inhibitor may be blended with the inventive refrigerating machine oil in order to enhance the stability thereof. Specific examples of such amine-based oxidation inhibitors are dipehnyl amine, dialkyldiphenyl amine of which alkyl group has 1 to 18 carbon atoms, phenyl-α-napthtyl amine, alkylphenyl-α-naphtyl amine of which alkyl group has 1 to 18 carbon atoms, phenothiazine and N-alkylphenothiazine of which alkyl group has 1 to 18 carbon atoms.

Alternatively, benzotriazole-based, thiadiazole-based and benzothiazole-based corrosion inhibitors may be blended with the inventive refrigerating machine oil in order to further enhance the stability thereof.

The benzotriazole-based corrosion inhibitor may be an (alkyl)benzotrizole compound represented by the formula (2)

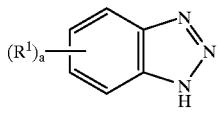

wherein $R^1$ is a straight or branched alkyl group having 1 to 4 carbon atoms, preferably methyl or ethyl group and a is an integer of 0 to 3, preferably 0 to 2; or an (alkyl) aminoalkylbenzotriazole compound represented by the formula (3)

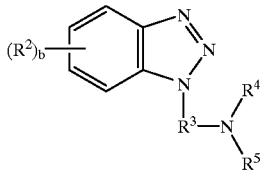

wherein $R^2$ is a straight or branched alkyl group having 1 to 4 carbon atoms, preferably methyl or ethyl group, $R^3$ is methylene or ethylene group, $R^4$ and $R^5$ are each independently a hydrogen atom or a straight or branched alkyl group having 1 to 18 carbon atoms, preferably a straight or branched alkyl group having 1 to 12 carbon atoms and b is an integer of 0 to 3, preferably 0 to 1.

The thiadiazole-based corrosion inhibitor may be a compound represented by the formula (4)

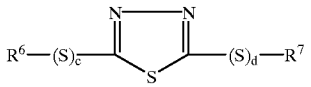

wherein $R^6$ is a straight or branched alkyl group having 1 to 30, preferably 6 to 24 carbon atoms, $R^7$ is a hydrogen atom or a straight or branched alkyl group having 1 to 30 carbon atoms, preferably a hydrogen atom or a straight or branched alkyl group having 1 to 24 carbon atoms and c and d may be the same or different from each other and are each independently an integer of 1 to 3, preferably 1 or 2.

The benzothiazole-based corrosion inhibitor may be a compound represented by the formula (5)

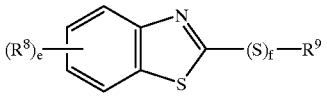

wherein $R^8$ is a straight or branched alkyl group having 1 to 4 carbon atoms, preferably methyl or ethyl group, $R^9$ is a straight or branched alkyl group having 1 to 30, preferably 6 to 24 carbon atoms, e is an integer of 0 to 3, preferably 0 or 1 and f is an integer of 1 to 3, preferably 1 to 2.

For the purpose of improving the capabilities of the refrigerating machine oil of the present invention, it may be blended with suitable conventional additives singly or in combination, which may be anti-wear additives such as zinc dithiophosphate; extreme pressure agents such as chlorinated paraffin and sulfur compounds; oiliness improvers such as a fatty acid; antifoaming agents such as silicone-based ones; viscosity index improvers; pour point depressants; and detergent-dispersants. These additives may be blended in an mount of preferably less than 10 mass percent, more preferably less than 5 mass percent, based on the total mass of the refrigerating machine oil (based on the total mass of the oil and the whole additives).

Although not restricted, the inventive refrigerating machine oil has a kinematic viscosity at 40° C. of preferably 3 to 100 $mm^2/s$, more preferably 4 to 50 $mm^2/s$, most preferably 5 to 40 $mm^2/s$ and a kinematic viscosity at 100° C. of preferably 1 to 20 $mm^2/s$, more preferably 2 to 10 $mm^2/s$.

The inventive refrigerating machine oil is used together with an ammonia refrigerant but is also useful for use with a refrigerant which is an mixture of ammonia and hydrofluorocarbon and/or hydrocarbon.

The hydrofluorocarbon refrigerants may be hydrofluorocarbon having 1 to 3 carbon atoms, preferably 1 to 2 carbon atoms. Specific examples of the hydrofluorocarbon refrigerants are difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a) and a mixture of at least two kinds of thereof.

These refrigerants are suitably selected in accordance with use and performances to be required. Preferred refrigerants are HFC-32 alone; HFC-23 alone; HFC-134a alone; HFC-125 alone; a mixture of HFC-134a/HFC-32 in a ratio of 60–80 mass %/40–20 mass %; a mixture of HFC-32/HFC-125 in a ratio of 40–70 mass %/60–30 mass %; a mixture of HFC-125/HFC-143a in a ratio of 40–60 mass %/60–40 mass %; a mixture of HFC-134a/HFC-32/HFC-125 in a ratio of 60 mass %/30 mass %/10 mass %; a mixture of HFC-134a/HFC-32/HFC-125 in a ratio of 40–70 mass %/15–35 mass %/5–40 mass % and a mixture of HFC-125/HFC134a/HFC-143a in a ratio of 35–55 mass %/1–15 mass %/40–60 mass %. More specifically, the HFC refrigerant mixtures include a mixture of HFC-134a/HFC-32 in a ratio of 70 mass %/30 mass %; a mixture of HFC-32/HFC-125 in a ratio of 60 mass %/40 mass %; a mixture of HFC-32/HFC-125 in a ratio of 50 mass %/50 mass % (R410A); a mixture of HFC-32/HFC-125 in a ratio of 45 mass %/55 mass % (R410B); a mixture of HFC-125/HFC-143a in a ratio of 50 mass %/50 mass % (R507C); a mixture of HFC-32/HFC-125/HFC-134a in a ratio of 30 mass %/10 mass %/60 mass %; a mixture of HFC-32/HFC-125/HFC-134a in a ratio of 23 mass %/25 mass %/52 mass % (R407C); a mixture of HFC-32/HFC-125/HFC-134a in the ratio of 25 mass %/15 mass %/60 mass % (R407E) and a mixture of HFC-125/HFC-134a/HFC-142a in a ratio of 44 mass %/4 mass %/52 mass % (R404A).

The hydrocarbon refrigerants may be those which are gaseous at 25° C. and one atmospheric pressure. Specific examples of the hydrocarbon refrigerants are alkanes, cycloalkanes and alkenes each having 1 to 5 carbon atoms, preferably 1 to 4 carbon atoms, such as methane, ethylene, ethane, propylene, propane, cyclopropane, butane, isobutane, cyclobutane, methylcyclopropane and a mixture of at least two kinds thereof.

The refrigerating machine oil according to the present invention is generally present in a refrigerating machine in the form of a fluid composition in which the refrigerating machine oil is mixed with the refrigerant containing ammonia as described above. The mixing ratio of the refrigerating machine oil to the refrigerant in this fluid composition may be optionally determined, but is generally within the range of 1 to 500 parts by weight, preferably 2 to 400 parts by weight, of the refrigerating machine oil per 100 parts by weight of the refrigerant.

The present invention will be further described with reference to the following Inventive Examples, Comparative Examples and Reference Example for the illustration purpose only.

INVENTIVE EXAMPLES 1 TO 5

COMPARATIVE EXAMPLES 1 TO 6 AND REFERENCE EXAMPLE 1

The following sample oils were used in Inventive Examples 1 to 5, Comparative Examples 1 to 6 and Reference Example 1. The properties (kinematic viscosity at 100° C.) of each of the sample oil are indicated in Table 1.

Sample oil A: $CH_3$-O-$(PO)_m$-H Number-average molecular weight 700 (Mw/Mn: 1.1)

Sample oil B: $CH_3$-O-$(PO)_m$-H Number-average molecular weight 1,500 (Mw/Mn: 1.1)

Sample oil C: $C_4H_9$-O-$(PO)_m$-H Number-average molecular weight 700 (Mw/Mn: 1.1)

Sample oil D: $C_4H_9$-O-$(PO)_m$-H Number-average molecular weight 1,500 (Mw/Mn: 1.1)

Sample oil E: $C_{10}H_{21}$-O-$(PO)_m$-H Number-average molecular weight 700 (Mw/Mn: 1.1)

Sample oil F: $CH_3$-O-$(PO)_m$-$CH_3$ Number-average molecular weight 800 (Mw/Mn: 1.1)

Sample oil G: $CH_3$-O-$(EO)_m$-$(PO)_n$-H (m:n=3:7) Number-average molecular weight 1,300 (Mw/Mn: 1.1)

Sample oil H: $C_4H_9$-O-$(EO)_m$-$(PO)_n$-$CH_3$ (m:n=3:7) Number-average molecular weight 900 (Mw/Mn: 1.1)

Sample oil I: $C_{12}H_{25}$-O-$(PO)_m$-H Number-average molecular weight 700 (Mw/Mn: 1.1)

Sample oil J: Naphthenic mineral oil

Sample oil K: Alkylbenzene of branched type

Each of the above sample oils was subjected to the following tests.

Miscibility Test

In accordance with "Testing Method of Evaluating Miscibility with a Refrigerant" prescribed in JIS K 2211 "Refrigerating machine oil", 5 grams of each of the sample oils per gram of an ammonia refrigerant were blended therewith to observe if the refrigerant and the sample oil would dissolve in each other or if they would be separated from each other or turned into a white-turbid liquid at a temperature within the range of −50–30° C. and to measure the upper critical temperature (the lowest temperature at which the refrigerant and the sample oil dissolved in each other) in the case where they dissolved in each other. The results are shown in Table 1.

Test for Evaluating Hygroscopicity 5 grams of each of the sample oils were weighed out into a commercially available 50 ml beaker to measure the amount of saturated water at a temperature of 25° C. and humidity of 80%. The results are shown in Table 1.

Test for Evaluating Stability 50 grams of each of the sample oils, 5 grams of ammonia and 0.5 gram of water with a catalyst in the form of an iron wire of 6 mm ϕ were charged into an autoclave and retained for two weeks after being heated to a temperature of 175° C. Ammonia was removed from the sample oil to observe the appearance of thereof and measure the total acid value thereof. The results were shown in Table 1.

TABLE 1

| | sample | Kinematic Viscosity mm2/s@100° C. | Miscibility ° C. | Hygro-scopicity mass ppm | Autoclave Test: Sample oil appearance | Autoclave Test: Catalyst appearance | Autoclave Test: Total acid value mgKOH/g |
|---|---|---|---|---|---|---|---|
| Example 1 | A | 6 | −28 | 32400 | Not changed | Not changed | 0.03 |
| Example 2 | B | 10 | −21 | 36300 | Not changed | Not changed | 0.02 |
| Example 3 | C | 7 | −15 | 31800 | Not changed | Not changed | 0.02 |
| Example 4 | D | 11 | −10 | 33000 | Not changed | Not changed | 0.02 |
| Example 5 | E | 15 | 7 | 29600 | Not changed | Not changed | 0.02 |
| Comparative Example 1 | F | 7 | −34 | 8600 | Not changed | less lustered | 0.09 |
| Comparative Example 2 | G | 10 | <−50 | 52300 | turbid | partially blackened | 0.15 |
| Comparative Example 3 | H | 9 | −40 | 9900 | Not changed | less lustered | 0.08 |
| Comparative Example 4 | I | 19 | Inmiscible | 27200 | Not changed | Not changed | 0.02 |
| Comparative Example 5 | J | 4 | Inmiscible | 150 | Not changed | Not changed | 0.02 |
| Comparative Example 6 | K | 3 | Inmiscible | 170 | Not changed | Not changed | 0.01 |

As apparent from the results in Table 1, the refrigerating machine oils of Inventive Examples had superior lubricity, miscibility with a refrigerant, fluidity at low temperatures and stability, all of which were well-balanced, when used with an ammonia refrigerant.

In contrast with these sample oils, it was found that all of the sample oils (Comparative Examples 1–4) containing the polyalkylene glycol compound other than the polypropylene glycol monoether specified by the present invention, the sample oil (Comparative Example 5) containing the naphthenic mineral oil and the sample oil (Comparative Example 6) containing the branched type alkylbenzene were inferior in lubricity, miscibility with a refrigerant, fluidity at low temperatures or stability.

As described above, the refrigerating machine oil according to the present invention can exhibit superior miscibility with ammonia, lubricity and stability which reach a high standard and are well-balanced by containing the polypropylene glycol monoether as a main component. Therefore, with the refrigerating machine oil according to the present invention, ammonia can fully perform its capabilities as a refrigerant.

What is claimed is:

1. A fluid composition for a refrigerating machine comprising an ammonia refrigerant and a refrigerating machine oil which comprises a polypropylene glycol monoether represented by formula (1):

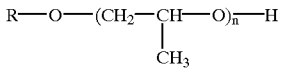

(1)

wherein R is an alkyl group having 1 to 10 carbon atoms, and wherein n is an integer selected such that the number average molecular weight of the polypropylene glycol monoether is about 500 to about 5,000.

2. The fluid composition according to claim 1, wherein the polypropylene glycol monoether comprises more than about 50 mass percent of the total mass of the oil.

3. The fluid composition according to claim 1, wherein the polypropylene glycol monoether comprises more than about 70 mass percent of the total mass of the oil.

4. The fluid composition according to claim 1, wherein the polypropylene glycol monoether comprises more than about 80 mass percent of the total mass of the oil.

5. The fluid composition according to claim 1, wherein the polypropylene glycol monoether comprises more than about 90 mass percent of the total mass of the oil.

6. The fluid composition according to claim 1, wherein the oil further comprises an amine-based oxidation inhibitor.

7. The fluid composition according to claim 1, wherein the oil further comprises a corrosion inhibitor selected from the group consisting of benzotriazole-, thiadiazole- and benzothiazole-based inhibitors.

8. The fluid composition according to claim 6, wherein the oil further comprises a corrosion inhibitor selected from the group consisting of benzotriazole-, thiadiazole- and benzothiazole-based inhibitors.

9. The fluid composition according to claim 1, where R in formula (1) is selected from the group consisting of methyl, ethyl, propyl, and butyl groups.

* * * * *